US010625393B2

(12) United States Patent
Qian et al.

(10) Patent No.: US 10,625,393 B2
(45) Date of Patent: Apr. 21, 2020

(54) CHEMICAL MECHANICAL POLISHING PADS HAVING OFFSET CIRCUMFERENTIAL GROOVES FOR IMPROVED REMOVAL RATE AND POLISHING UNIFORMITY

(71) Applicant: Rohm and Haas Electronic Materials CMP Holdings, Inc., Newark, DE (US)

(72) Inventors: Bainian Qian, Newark, DE (US); Teresa Brugarolas Brufau, Philadelphia, PA (US); Julia Kozhukh, Bear, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 117 days.

(21) Appl. No.: 15/617,263

(22) Filed: Jun. 8, 2017

(65) Prior Publication Data

US 2018/0354094 A1 Dec. 13, 2018

(51) Int. Cl.
*B24B 37/26* (2012.01)
*B24B 37/22* (2012.01)

(52) U.S. Cl.
CPC ..... *B24B 37/26* (2013.01); *B24B 37/22* (2013.01)

(58) Field of Classification Search
CPC ..... B24B 37/22; B24B 37/26; B24B 37/20; B24B 37/205
USPC ..... 451/526, 527, 529, 533, 534, 536
See application file for complete search history.

(56) References Cited

U.S. PATENT DOCUMENTS

| | | | | |
|---|---|---|---|---|
| 5,650,039 | A * | 7/1997 | Talieh | B24B 37/26 216/89 |
| 5,842,910 | A * | 12/1998 | Krywanczyk | B24B 37/26 451/41 |
| 7,531,105 | B2 | 5/2009 | Dysard et al. | |
| 7,927,187 | B2 * | 4/2011 | Watanabe | B24B 37/26 451/41 |
| 9,409,276 | B2 * | 8/2016 | Tsai | B24B 37/26 |
| 2004/0014413 | A1 * | 1/2004 | Kawahashi | B24B 37/26 451/527 |
| 2006/0229002 | A1 | 10/2006 | Muldowney | |
| 2012/0190281 | A1 * | 7/2012 | Allison | B24D 11/001 451/527 |

* cited by examiner

*Primary Examiner* — Robert A Rose
(74) *Attorney, Agent, or Firm* — Andrew Merriam; Blake T. Biederman

(57) ABSTRACT

The present invention provides a chemical mechanical (CMP) polishing pad for planarizing at least one of semiconductor, optical and magnetic substrates comprising a polishing layer that has a geometric center, and in the polishing layer a plurality of offset circumferential grooves, such as circular or polygonal grooves, which have a plurality of geometric centers and not a common geometric center. In the polishing layer of the present invention, each circumferential groove is set apart a pitch distance from its nearest or adjacent circumferential groove or grooves; for example, the pitch increases on the half or hemisphere of the polishing layer that is farthest from the geometric center of its innermost circumferential groove and decreases on the half of the polishing layer nearest that geometric center. Preferably, the polishing layer contains an outermost circumferential groove that is complete and continuous.

9 Claims, 4 Drawing Sheets

CHEMICAL MECHANICAL POLISHING PADS HAVING OFFSET CIRCUMFERENTIAL GROOVES FOR IMPROVED REMOVAL RATE AND POLISHING UNIFORMITY

The present invention relates to chemical mechanical polishing (CMP polishing) pads having a polishing layer having a geometric center, the polishing layer containing a plurality of circumferential grooves each having a distinct geometric center which is offset from the geometric center of the polishing layer, wherein the plurality of circumferential grooves have a plurality geometric centers and not a common geometric center. Preferably, the CMP polishing layer further contains an outermost circumferential groove that is concentric with the polishing layer or that has a common geometric center with the polishing layer itself. Further, the present invention relates to methods of making the CMP polishing pads.

Semiconductor wafers having integrated circuits fabricated thereon must be polished to provide an ultra-smooth and flat surface that must vary in a given plane by less than a fraction of a micron. This polishing is usually accomplished in chemical mechanical polishing (CMP polishing). In CMP polishing, a wafer carrier, or polishing head, is mounted on a carrier assembly. The polishing head holds the semiconductor wafer and positions the wafer in contact with a polishing layer of a polishing pad that is mounted on a table or platen within a CMP apparatus. The carrier assembly provides a controllable pressure or down force between the wafer and polishing pad while a polishing medium (e.g., slurry) is dispensed onto the polishing pad and is drawn into the gap or interface between the wafer and polishing layer all over the surface of the substrate and the polishing pad. In the CMP polishing of semiconductor wafer substrates with a rotary polishing tool, a circular polishing pad is secured onto a circular platen (also known as polishing table) of the CMP apparatus by, for example, using a removable adhesive film. The carrier center of rotation and table center of rotation are typically offset. To effect polishing, the polishing pad and wafer typically rotate relative to one another. As the polishing pad rotates beneath the wafer, the wafer sweeps out a typically annular polishing track, or polishing region.

To facilitate polishing medium or slurry transport into the polishing pad-wafer interface for effective polishing, macro-grooves are either machined or molded on the polishing surface of a polishing pad. Concentric circular grooves, such as 1010 (3.05 mm or 120-mil pitch), K7 (1.78 mm or 70-mil pitch), K1 (1.52 mm or 60-mil pitch), and OXP (0.76 mm or 30-mil pitch), are some commonly adopted groove patterns. In addition to concentric circular grooves, other groove patterns include concentric polygons, with or without optional radial grooves.

The realization of successful CMP polishing remains a challenge. One recent study recognized a transfer of a CMP polishing layer groove pattern from the polishing pad onto a polished wafer surface. When there was no carrier oscillation, concentric circular groove pattern of the CMP polishing pad was transferred to the polished wafer surface, with the same pitch as the circumferential grooves on the polishing pad and an amplitude close to 600 Å (±300 Å). Such "pattern transfer" to a polished wafer surface needs to be minimized to effectively achieve a planar wafer surface as a result of CMP polishing. There are different approaches to minimize this "pattern transfer" and improve polishing uniformity, such as by introducing polishing oscillation. Methods of introducing polishing oscillation include:

Different platen and carrier RPM's, wafer carrier or polishing table oscillation, circular grooves with reduced pitch, circular grooves with an off-center final cut, and non-circular or irregular grooves. While each such approach can help to minimize the "pattern transfer", it will not eliminate it completely. For example, with wafer carrier oscillation, the amplitude of the pattern on a polished wafer surface was reduced down to about ⅓ when compared to that with no carrier oscillation, but still produced a pattern transfer of about 200 Å (±100 Å).

U.S. Pat. No. 5,842,910, to Krywanczyk et al., discloses a polishing pad for polishing a semiconductor having a pad face having a surface extending across a center of rotation; and a plurality of raised portions, on said pad face, sharing a common geometric center and extending in a generally circumferential direction, wherein the common geometric center is off-center with the center of rotation of the polishing pad. The off-center groove cut of Krywanczyk results in a pad with a polishing layer with partial grooves at its periphery. The partial grooves at a polishing layer periphery can be worn out or torn by a conditioning disk during pad break-in and polishing, thereby resulting in sharp edges. Such sharp edges are readily torn out by a pad conditioning disk or by friction caused during polishing, generating large amounts of pad debris and an uneven pad surface, a potential source for high defectivity in polished substrates. Alternatively, to minimize the negative impact of sharp edges from partial grooves, one can introduce a groove exclusive edge ring, i.e., the grooves stop some distance before the polishing layer periphery. However, this results in reduced removal rates in polishing and uneven wear of the polishing layer surface which can further hamper polishing uniformity.

The present inventors have sought to solve the problem of providing CMP polishing pads having grooves in their polishing layer surfaces which improve polishing uniformity without increasing defectivity.

STATEMENT OF THE INVENTION

1. In accordance with the present invention, a chemical mechanical (CMP) polishing pad for planarizing at least one of semiconductor, optical and magnetic substrates comprises a polishing layer, preferably, a circular polishing layer, that has a geometric center, the polishing layer containing a plurality of offset circumferential grooves which have a plurality geometric centers and not a common geometric center, each circumferential groove being set apart a pitch distance from its nearest or adjacent circumferential groove or grooves.

2. The CMP polishing pad as in item 1, above, wherein the polishing layer contains an outermost circumferential groove that is complete and continuous and that is concentric with the polishing layer itself or has a common geometric center with and is not offset from the geometric center of the polishing layer.

3. The CMP polishing pad as any one of items 1 or 2, above, wherein in the polishing layer having the plurality of offset circumferential grooves, when going from the innermost circumferential groove to the outermost circumferential groove the relative location of the geometric center of each successive offset circumferential groove moves toward the geometric center of the polishing layer; and, the outermost circumferential groove of the polishing layer has a geometric center substantially corresponding with the geometric center of the polishing layer and is, thus, not offset.

4. The CMP polishing pad as in any one of items 1, 2, or 3, above, wherein except for the innermost and the outermost circumferential groove, each of the plurality of offset circumferential grooves has two adjacent circumferential grooves and the geometric centers of the majority of the offset circumferential grooves that have two adjacent circumferential grooves are offset from the geometric centers of their respective two adjacent circumferential grooves.

5. The CMP polishing pad as in any one of items 1, 2, 3, or 4, above, wherein except for the innermost and the outermost circumferential groove, each of the plurality of offset circumferential grooves has two adjacent circumferential grooves and the majority or, preferably, all of the offset circumferential grooves that have two adjacent circumferential grooves are offset from their respective two adjacent circumferential grooves by from 25 to 200 μm (1 to 8 mils), the offset being defined by the distance between the adjacent circumferential grooves at any given point and the average pitch between the adjacent circumferential grooves.

6. The CMP polishing pad as in any one of items 1, 2, 3, 4, or 5, above, wherein the majority or, preferably, all of the offset circumferential grooves except the outermost circumferential groove are offset by 200 μm (8 mils) or more or from 200 to 35,000 μm, or, preferably, from 500 to 21,500 μm (from 20 to 828 mil) from the geometric center of the polishing layer.

7. The CMP polishing pad as in any one of items 1, 2, 3, 4, 5, or 6, above, wherein each of the circumferential grooves in polishing pad is polygonal, having from 3 to 36 sides, or, preferably, from 5 to 16 sides, or is substantially circular.

8. The CMP polishing pad as in any one of items 1, 2, 3, 4, 5, 6, or 7, above, wherein the polishing layer comprises a plurality of radial grooves, preferably, the radial grooves being evenly spaced in a radial fashion.

9. The CMP polishing pad as in item 8, above, wherein the number of radial grooves in the polishing layer ranges from 3 to 36, or, preferably, from 5 to 16.

10. The CMP polishing pad as in any one of items 1, 2, 3, 4, 5, 6, 7, 8, or 9, above, wherein the circumferential grooves have an average pitch or distance between any two adjacent circumferential grooves which is the pitch between the adjacent circumferential grooves along an axis extending from the geometric center C of the innermost circumferential groove to the outermost edge of the polishing layer that runs perpendicular to an axis that extends from geometric center C of the polishing layer along the plurality of geometric centers in the polishing layer to the outermost edge of the polishing layer.

11. The CMP polishing pad as in any one of items 1, 2, 3, 4, 5, 6, 7, 8, 9, or 10, above, wherein the outermost circumferential groove lies a constant distance from the outermost edge of the polishing layer and the plurality of circumferential grooves extends all the way to the edge of polishing layer or extends to a distance equal to or less than the average pitch between the outermost circumferential groove and its nearest adjacent circumferential groove to the outermost edge of the polishing layer, or, preferably, within 2.75 mm, or, preferably, from 0.7 to 2.6 mm of the outermost edge of the polishing layer.

12. In another aspect, a method of making a chemical mechanical (CMP) polishing layer in accordance with any one of items 1 to 11 of the present invention, above, comprises providing a polymeric or porous polymeric CMP polishing layer, preferably, a circular CMP polishing layer, and machining or punching the plurality of circumferential grooves and any radial grooves into the polishing layer.

13. In yet another aspect, a method of making a chemical mechanical (CMP) polishing layer in accordance with any one of items 1 to 11 of the present invention, above, comprises: making a non-stick mold with a negative image of the plurality circumferential groove, preferably, wherein the mold is made of or is lined with a fluoropolymer, such as polytetrafluoroethylene; providing a tank containing at least a stream of a polyol and a chain extender; providing a second tank containing a stream of a polyisocyanate; providing metering pump units to meter and pump the two streams separately into downstream mixing equipment; pumping the two streams into any of a spray gun equipped with an internal mixer and a non-reactive gas inlet, and a spray nozzle outlet; a static mixer with an air blast cap outlet; or a cylindrical mixing chamber where impingement mixing takes place and a gas delivery system to introduce a high velocity non-reactive gas stream into the reactive mixture through a channel downstream of the cylindrical mixing chamber; mixing the two streams to form a reaction mixture, including the non-reactive gas except in the case of the static mixer where no gas is added; discharging the reactive mixture through the spray nozzle or air blast cap and depositing it onto the mold; and, curing and then demolding the thus deposited reaction mixture to form the polishing layer.

Unless otherwise indicated, conditions of temperature and pressure are ambient or room temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, unless otherwise indicated, the term "average particle size" or "average particle diameter" means a weight average particle size as determined by a light scattering method using Mastersizer 2000 from Malvern Instruments (Malvern, United Kingdom).

As used herein, the term "average pitch" between any two adjacent circumferential grooves in a polishing layer means the distance between the grooves measured along an axis extending from the geometric center C of the innermost circumferential groove in the polishing layer to the outermost edge of the polishing layer that runs perpendicular to an axis that extends from geometric center C along the plurality of geometric centers in the polishing layer to the outermost edge of the polishing layer.

As used herein, the term "ASTM" refers to publications of ASTM International, West Conshohocken, Pa.

As used herein, the term "polyisocyanate" means any isocyanate group containing molecule having three or more isocyanate groups, including blocked isocyanate groups.

As used herein, the term "polyisocyanate prepolymer" means any isocyanate group containing molecule that is the reaction product of an excess of a diisocyanate or polyisocyanate with an active hydrogen containing compound containing two or more active hydrogen groups, such as diamines, diols, triols, and polyols.

As used herein, the term "solids" means any material other than water or ammonia that does not volatilize in use conditions, no matter what its physical state. Thus, liquid reactants that do not volatilize in use conditions are considered "solids".

As used herein, the term "substantially circular" refers to a circumferential groove which has one and only one geometric center that can be a point or multiple points which lie within a circular area having a radius of less than 50 microns, or, preferably, less than 25 microns, or, more preferably, less than 2 microns. The size of the geometric center of any circumferential groove is less than the distance which any of the plurality of circumferential grooves in the polishing layer is offset from any of its neighboring or adjacent circumferential grooves; thus, for example, where two or three adjacent circumferential grooves are not offset from each other, they have one and the same geometric center.

As used herein, the term "substantially corresponding with" means at or with 25 microns in any direction of a given point, such as the outermost edge of a polishing layer of the present invention.

As used herein, unless otherwise indicated, the term "viscosity" refers to the viscosity of a given material in neat form (100%) at a given temperature as measured using a rheometer, set at an oscillatory shear rate sweep from 0.1-100 rad/sec in a 50 mm parallel plate geometry with a 100 μm gap.

As used herein, unless otherwise indicated, the term "wt. % NCO" refers to the amount as reported on a spec sheet or MSDS for a given NCO group or blocked NCO group containing product.

As used herein, the term "wt. %" stands for weight percent.

Figure 1:
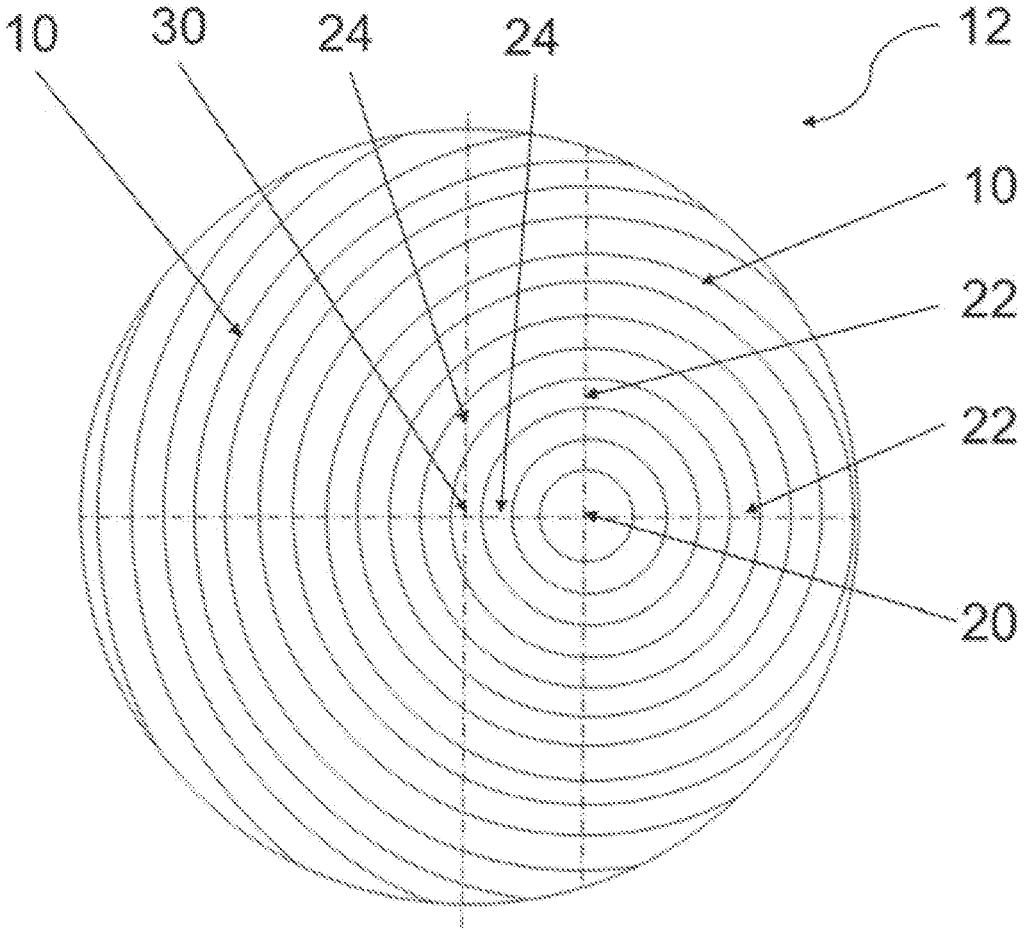
FIG. 1 represents an embodiment of a prior art off-center final cut of a polishing layer having concentric circumferential grooves.

In accordance with the present invention, chemical mechanical (CMP) polishing pads comprise a polishing layer with a geometric center and containing a plurality of circumferential grooves, each of which or a majority of which has its own distinct and unique geometric center and which is offset from the geometric center of the polishing layer. The polishing layer in accordance with the present invention further contains an outermost circumferential groove that is concentric with the polishing layer or that has a common geometric center with the polishing layer itself. The polishing pad of the present invention delivers higher removal rate and better defect performance than a polishing pad having offset circumferential grooves with a common geometric center, all without an increase in polishing temperature in use. Further, the CMP polishing pad of the present invention reduces pattern transfer between the groove pattern in the CMP polishing layer and the substrate being polished.

The polishing layer of the chemical mechanical polishing pad of the present invention has a polishing surface adapted for polishing the substrate, wherein the polishing surface has a macrotexture comprising a groove pattern comprising a plurality of grooves. The plurality of circumferential grooves is chosen from curved grooves, linear grooves, and combinations thereof.

Suitable groove patterns are selected from a groove design, such as one selected from concentric grooves which may be circular or polygonal. The groove profile is preferably selected from rectangular with straight side walls or the groove cross section may be "V" shaped, "U" shaped, saw-tooth, and combinations thereof.

Preferably, in the polishing layer of the polishing pad of the present invention, most or all of the circumferential grooves are offset from their neighboring circumferential grooves so that most or all circumferential grooves have a geometric center that is different than the geometric center of its neighboring or adjacent circumferential groove.

In accordance with the polishing layer of the present invention, the majority of the circumferential grooves may be offset from their respective two adjacent circumferential grooves by from 25 to 200 μm (1 to 8 mils) and at least 500 microns (20 mil) offset from the geometric center of the circular polishing pad. In the polishing layer of the present invention each such circumferential groove which is offset from its adjacent circumferential groove has its own distinct geometric center which is offset from the geometric center of the polishing layer and that of each of its adjacent circumferential grooves.

The polishing layer of the present invention may further comprise a plurality of radial grooves, which are linear, curved, or a combination thereof.

In accordance with the methods of making polishing pads in accordance with the present invention, CMP polishing pads can be provided with a groove pattern cut, ground, routed, lathed or molded into their polishing surface to promote slurry flow and to remove polishing debris from the pad-wafer interface. Such grooves may be cut into the polishing surface of the polishing pad either using a lathe or by a Computer Numerical Control (CNC) milling machine. While the offset grooves of the present invention are suitably milled with a CNC machine, milling tends to be more time-consuming thus economically less favorable. Instead, a fluoropolymer or fluoropolymer lined mold with negative image of the final groove patterns can be milled and the resulting mold can be used to make CMP polishing pads with any molding technique such as spray molding, compression molding, or reactive injection molding.

As shown in FIG. 1, an embodiment of a prior art CMP polishing pad showing an off-center final cut of a polishing layer (12) has concentric circumferential grooves (10) with a common geometric center (20), with x,y axes (22) emanating therefrom, offset from the geometric center (30) of the polishing layer, with x,y axes (24) emanating therefrom.

Figure 2A:
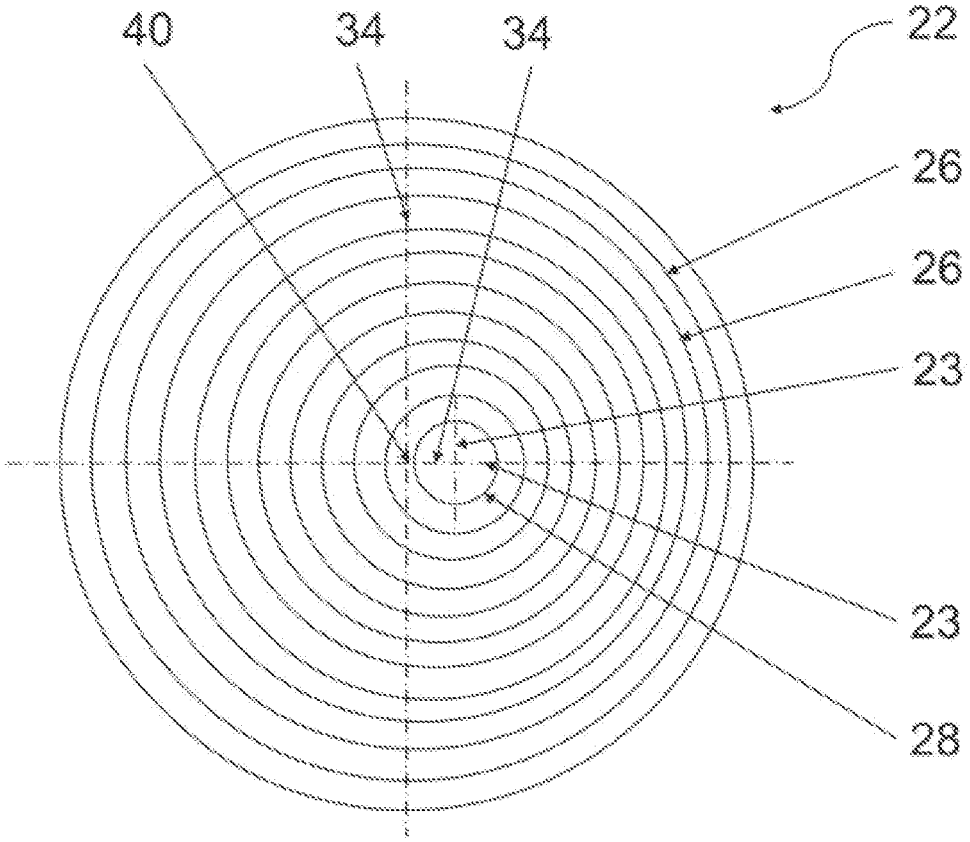
FIG. 2A represents an embodiment of the present invention without radial grooves.

As shown in FIG. 2A, an embodiment of the CMP polishing pad of the present invention without radial grooves comprises a polishing layer (22) has circular circumferential grooves (26) that are not concentric, showing x,y axes (23) for the geometric center of the innermost circumferential groove (28), and which are offset from the geometric center (40), showing x,y axes (34), of the polishing layer.

Figure 2B:
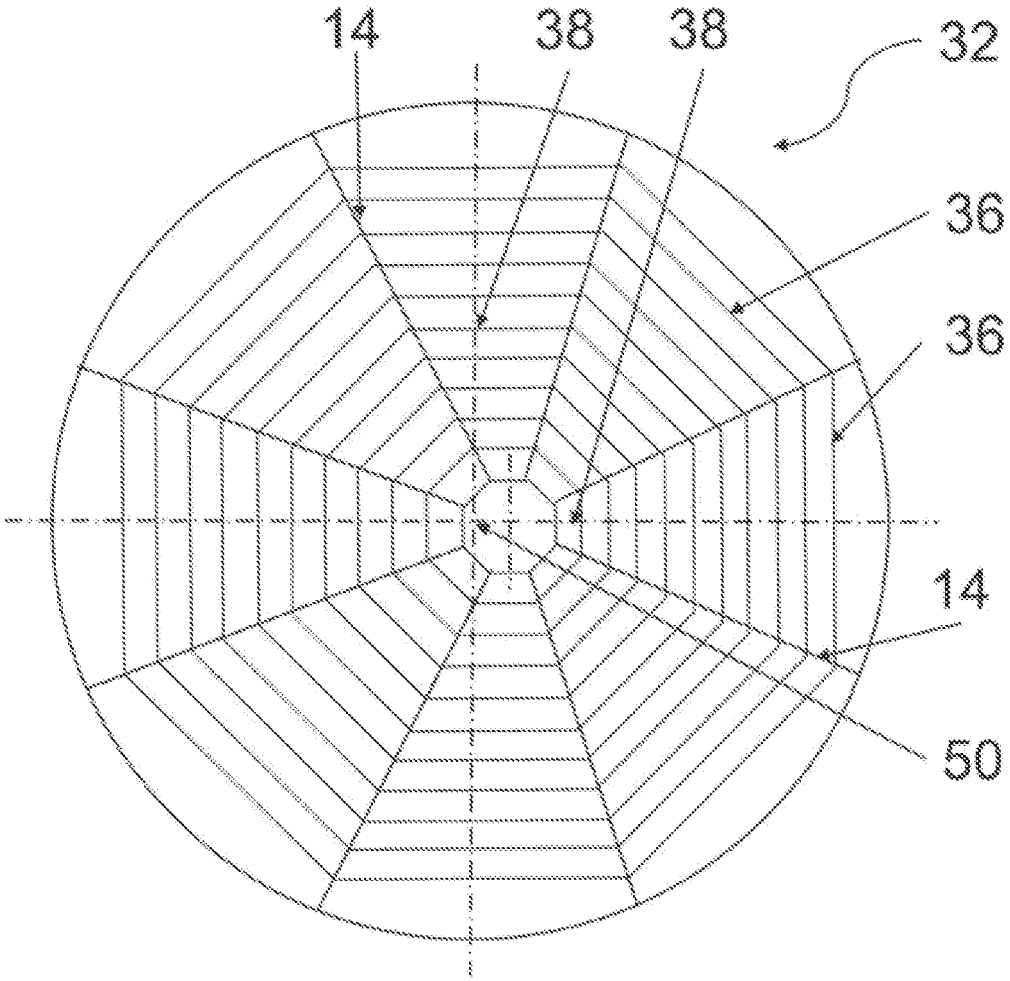
FIG. 2B represents an embodiment of the present invention with radial grooves.

As shown in FIG. 2B, an embodiment of the present invention with radial grooves (14) comprises a polishing layer (32) has octagonal circumferential grooves (36) that are not concentric, with an axis for the geometric center of the polishing layer, and which are offset from the geometric center (50), and showing x,y axes (38) emanating from the geometric center of the polishing layer. Another version of this CMP polishing pad (not shown) does not have radial grooves.

Figure 3:
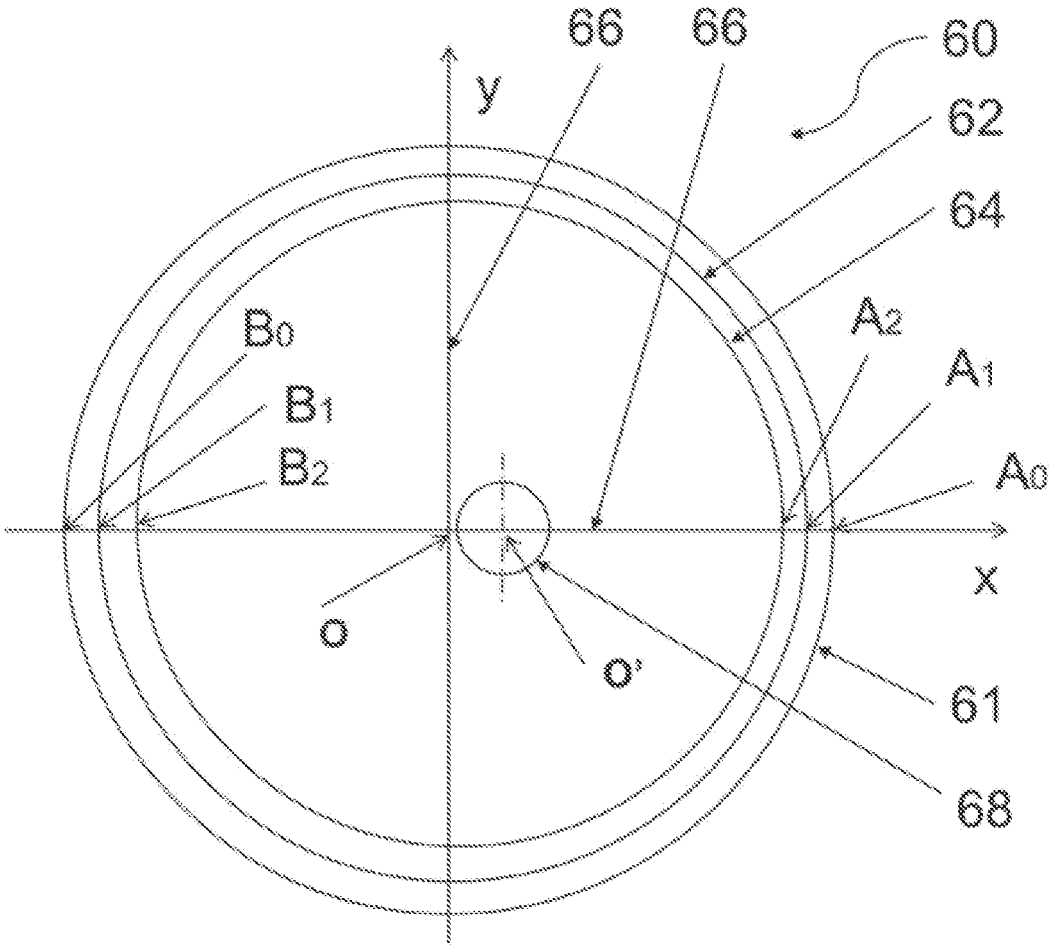
FIG. 3 represents an embodiment of the present invention showing the geometric center of the polishing layer and the variable geometric center of the circumferential grooves in the polishing layer.

As shown in FIG. 3 the geometric center (O) of the polishing layer (60), with x,y axes (66), corresponds to point (0,0). The figure demonstrates the variable geometric center of the circumferential grooves in the polishing layer. Three circumferential grooves (61, 62 and 64) are shown, with groove (61) being the outmost circumferential groove which has the same geometric center (O) as the polishing pad. There is an offset distance between the two neighboring grooves (62) and (64). The distance between two neighboring grooves (62) and (64) varies from the smallest at $A_1A_2$ to the largest at $B_1B_2$, where $A_1A_2$ equals the average pitch minus the offset amount and $B_1B_2$ equals the average pitch plus the offset amount. The center of the innermost circumferential groove (68), with a geometrical center (O'), corresponds to a maximum offset from the center of the polishing pad (O). Every geometric center of each circumferential groove (61, 62, 64 and 68) lines up on the x axis of x,y axes (66) and is offset from the point O (0,0) by a different distance. Thus, the average pitch between any two adjacent circumferential grooves is the pitch measured along an axis extending from a specific geometric center C of the innermost circumferential groove to the outermost edge of the polishing layer that runs perpendicular to the x axis (66) of FIG. 3. As one approaches the outer circumferential groove, the geometric center of the circumferential groove approaches the actual geometric center (O); the outermost circumferential groove is not offset from the geometric center (O) of the polishing layer; thus, the outermost groove lies a constant distance from the geometric center (O) of the polishing layer and from the outermost edge of the polishing layer.

The polymeric pad matrix of the present invention contains a polishing layer which may be porous and have therein polymeric microelements distributed within the polymeric pad matrix and at the polishing surface of the polymeric pad matrix. The fluid filling the liquid-filled microelements is, preferably, water, isobutylene, isobutene, isobutane, isopentane, propanol or di(m)ethyl ether, such as distilled water that only contains incidental impurities. After classifying the liquid-filled microelements, the resulting microelements are converted to gas-filled microelements before or during the formation of the polishing layer. The microelements in the CMP polishing pad are polymeric and have an outer polymer surface, enabling them to creating texture at the CMP polishing surface.

In accordance with the present invention, the microelements are incorporated into the CMP polishing layer at from 0 to 50 vol. % porosity, or, preferably, from 5 to 35 vol. % porosity. To insure homogeneity and good molding results and fill the mold completely, the reaction mixture of the present invention should be well dispersed.

Suitable liquid polymer matrix forming materials include polycarbonate, polysulfone, polyamides, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. The polymer may be in the form of a solution or dispersion or as bulk polymer. Preferably, the polymeric material is a polyurethane in bulk form; and may be either a cross-linked a non-cross-linked polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Preferably, the liquid polymer matrix forming material is a block or segmented copolymer capable of separating into phases rich in one or more blocks or segments of the copolymer. Most preferably, the liquid polymer matrix forming material is a polyurethane. Cast polyurethane matrix materials are particularly suitable for planarizing semiconductor, optical and magnetic substrates. An approach for controlling a pad's CMP polishing properties is to alter its chemical composition. In addition, the choice of raw materials and manufacturing process affects the polymer morphology and the final properties of the material used to make polishing pads.

The liquid polymer matrix forming material can comprise (i) one or more diisocyanate, polyisocyanate or polyisocyanate prepolymer, wherein the prepolymer has a 6 to 15 wt. % NCO content, preferably, an aromatic diisocyanate, polyisocyanate or polyisocyanate prepolymer, such as toluene diisocyanate, and (ii) one or more curative, preferably, an aromatic diamine curative, such as 4,4'-methylenebis(3-chloro-2,6-diethylaniline) (MCDEA). The curative and the polyisocyanate prepolymer are together called a reaction mixture.

Preferably, urethane production involves the preparation of an isocyanate-terminated urethane prepolymer made from a polyfunctional aromatic isocyanate and a prepolymer polyol. For purposes of this specification, the term prepolymer polyol includes diols, polyols, polyol-diols, copolymers thereof and mixtures thereof.

Examples of suitable aromatic diisocyanates or polyisocyanates include aromatic diisocyanates, such as, 2,4-toluene diisocyanate, 2,6-toluene diisocyanate, 4,4'-diphenylmethane diisocyanate, naphthalene-1,5-diisocyanate, toluidine diisocyanate, para-phenylene diisocyanate, xylylene diisocyanate and mixtures thereof. Generally, a polyfunctional aromatic isocyanate contains less than 20 wt. % aliphatic isocyanates, such as 4,4'-dicyclohexylmethane diisocyanate, isophorone diisocyanate and cyclohexanediisocyanate, based on the total weight of the total (i). Preferably, the aromatic diisocyanate or polyisocyanate contains less than 15 wt. % aliphatic isocyanates and more preferably, less than 12 wt. % aliphatic isocyanate.

Examples of suitable prepolymer polyols include polyether polyols, such as, poly(oxytetramethylene)glycol, poly(oxypropylene)glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1, 3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Available examples of PTMEG family polyols are as follows: Terathane™ 2900, 2000, 1800, 1400, 1000, 650 and 250 from Invista, Wichita, Kans.; Polymeg™ 2900, 2000, 1000, 650 from Lyondell Chemicals, Limerick, Pa.; PolyTHF™ 650, 1000, 2000 from BASF Corporation, Florham Park, N.J., and lower molecular weight species such as 1,2-butanediol, 1,3-butanediol, and 1,4-butanediol. Available examples of PPG polyols are as follows: Arcol™ PPG-425, 725, 1000, 1025, 2000, 2025, 3025 and 4000 from Covestro, Pittsburgh, Pa.; Voranol™ 1010L, 2000L, and P400 from Dow, Midland, Mich., Desmophen™ 1110BD or Acclaim™ Polyol 12200, 8200, 6300, 4200, 2200, each from Covestro. Available examples of ester polyols are as follows: Millester™ 1, 11, 2, 23, 132, 231, 272, 4, 5, 510, 51, 7, 8, 9, 10, 16, 253, from Polyurethane Specialties Company, Inc. Lyndhurst, N.J.; Desmophen™ 1700, 1800, 2000, 2001KS, 2001K2, 2500, 2501, 2505, 2601, PE65B from Covestro; Rucoflex™ S-1021-70, S-1043-46, S-1043-55 from Covestro.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 6.0 to 20.0 weight percent.

For polyurethanes formed with PTMEG or PTMEG blended with PPG, the preferable weight percent NCO is a range 6 to 13.0; and most preferably it is 8.75 to 12.0.

A suitable polyurethane polymeric material may be formed from a prepolymer reaction product of 4,4'-diphenylmethane diisocyanate (MDI) and polytetramethylene glycol with a diol. Most preferably, the diol is 1,4-butanediol (BDO). Preferably, the prepolymer reaction product has 6 to 13 wt % unreacted NCO.

The polishing layer is formed from a reaction mixture of a prepolymer reaction product cured with a curative, such as a polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine.

To increase the reactivity of a polyol with a diisocyanate or polyisocyanate to make a polyisocyanate prepolymer, a catalyst may be used. Suitable catalysts include, for example, oleic acid, azelaic acid, dibutyltindilaurate, 1,8-Diazabicyclo[5.4.0]undec-7-ene (DBU), tertiary amine catalysts, such as Dabco TMR, and mixture of the above.

The components of the polymer used to make the polishing pad are preferably chosen so that the resulting pad morphology is stable and easily reproducible. For example, when mixing 4,4'-methylene-bis-o-chloroaniline (MBCA) with diisocyanate to form polyurethane polymers, it is often advantageous to control levels of monoamine, diamine and triamine. Controlling the proportion of mono-, di- and triamines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

Many suitable prepolymers, such as, Adiprene™ LFG740D, LF700D, LF750D, LF751D, and LF753D prepolymers (Chemtura Corporation, Philadelphia, Pa.) are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

A suitable stoichiometric ratio of the sum of the amine ($NH_2$) groups and the hydroxyl (OH) groups in the curative plus any free hydroxyl groups in a reaction mixture to the unreacted isocyanate groups in the liquid polyurethane matrix forming material is from 0.80:1 to 1.20:1, or, preferably 0.85:1 to 1.1:1.

The CMP polishing layer of the CMP polishing pad of the present invention exhibits a density of >0.5 g/cm$^3$ as measured according to ASTM D1622-08 (2008). Thus, the polishing layer of the chemical mechanical polishing pad of the present invention exhibits a density of 0.6 to 1.2 g/cm$^3$, or, preferably, 0.7 to 1.1 g/cm$^3$, or, more preferably, 0.75 to 1.0 g/cm$^3$, as measured according to ASTM D1622-08 (2008).

The CMP polishing pad of the present invention exhibits a Shore D hardness (2s) of 30 to 90 as measured according to ASTM D2240-15 (2015), or, preferably, from 35 to 80, or, more preferably 40 to 70.

Preferably, the polishing layer used in the CMP polishing pad of the present invention has an average thickness of from 500 to 3750 μm (20 to 150 mils), or, more preferably, from 750 to 3150 μm (30 to 125 mils), or, still more preferably, from 1000 to 3000 μm (40 to 120 mils), or, most preferably, from 1250 to 2500 μm (50 to 100 mils).

The CMP polishing pad of the present invention optionally further comprises at least one additional layer interfaced with the polishing layer. Preferably, the CMP polishing pad optionally further comprises a compressible sub pad or base layer adhered to the polishing layer. The compressible base layer preferably improves conformance of the polishing layer to the surface of the substrate being polished.

In accordance another aspect of the present invention, the CMP polishing pads can be formed by molding or casting the liquid polymer matrix forming material containing microelements to form a polymeric pad matrix. The forming of the CMP polishing pad can further comprise stacking a sub pad layer, such as a polymer impregnated non-woven, or polymer sheet, onto bottom side of a polishing layer so that the polishing layer forms the top of the polishing pad.

The methods of making a CMP polishing pad of the present invention may comprise providing a mold; pouring pad forming mixture of the present invention into the mold; and, allowing the combination to react in the mold to form a cured cake; wherein the CMP polishing layer is derived from the cured cake. Preferably, the cured cake is skived to derive multiple polishing layers from a single cured cake. Optionally, the method further comprises heating the cured cake to facilitate the skiving operation. Preferably, the cured cake is heated using infrared heating lamps during the skiving operation in which the cured cake is skived into a plurality of polishing layers.

In accordance with yet another aspect, the present invention provides methods of polishing a substrate, comprising: providing a substrate selected from at least one of a magnetic substrate, an optical substrate and a semiconductor substrate; providing a chemical mechanical (CMP) polishing pad according to the present invention, such as those recited in any one of the methods of forming CMP polishing pads in items 1 to 10, in the Statement of the Invention, above; creating dynamic contact between a polishing surface of the polishing layer of the CMP polishing pad and the substrate to polish a surface of the substrate; and, conditioning of the polishing surface of the polishing pad with an abrasive conditioner.

In accordance with the methods of using the polishing pads of the present invention, the polishing surface of the CMP polishing pads can be conditioned. Pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". Polishing pad conditioning is typically achieved by abrading the polishing surface mechanically with a conditioning disk. The conditioning disk has a rough conditioning surface typically comprised of imbedded diamond points. The conditioning process cuts microscopic furrows into the pad surface, both abrading and plowing the pad material and renewing the polishing texture.

Conditioning the polishing pad comprises bringing a conditioning disk into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated.

The chemical mechanical polishing pad of the present invention can be used for polishing a substrate selected from at least one of a magnetic substrate, an optical substrate and a semiconductor substrate.

Preferably, the method of polishing a substrate of the present invention, comprises: providing a substrate selected from at least one of a magnetic substrate, an optical substrate and a semiconductor substrate (preferably a semiconductor substrate, such as a semiconductor wafer); providing a chemical mechanical polishing pad according to the present invention; creating dynamic contact between a polishing surface of the polishing layer and the substrate to polish a surface of the substrate; and, conditioning of the polishing surface with an abrasive conditioner.

Some embodiments of the present invention will now be described in detail in the following Examples:

Three molds were used to make CMP polishing pads with spray molding via impingement mixing, to make polishing layer with molded K7, molded K7-3 or molded K7-10 grooves, with groove dimension shown in Table 2. The spray formulation details are summarized in Table 1, below. The POLY side was a mixture of long chain polyol, short chain extender, surfactant, catalysts, and foaming agent. The ISO side contained only a polyisocyanate prepolymer. The weight ratio of ISO to POLY, I/P, was 1.542 and 1.38, for Formulation A and Formulation B, respectively, to target an active hydrogen to isocyanate stoichiometric ratio of 95%. Specflex™ NR 556 is an amine-$CO_2$ carbamate foaming agent adduct (Dow). All sprayed molded sheets were cured in an oven at 104° C. for 16 hours and the fully cured polishing layer was adhered with a pressure sensitive adhesive (PSA) to a Suba™ IV felt sub-pad (Dow) for polishing evaluation. Another, Comparative Example 4, control pad, IC1000 (Dow), was also finished with K7 grooves and the Suba™ IV sub-pad for comparison.

TABLE 1

Polishing Layer Formulations

| Component | Description | Form A Wt. % | Form B Wt. % |
|---|---|---|---|
| | POLY side (P) | | |
| Voranol ™,[1] 5055 HH | Long chain polyol, MW 11,400, with 6 OH functionality | 77.62 | 77.62 |
| Ethylene glycol | Short chain extender, MW 62, with 2 OH functionality | 21.0 | 21.0 |
| Tegostab ™,[2] B-8418 | Silicone surfactant | 1.23 | 1.23 |
| Fomrez ™,[3] UL 28 | Tin catalyst | 0.05 | 0.05 |
| Dabco ™,[2] 33LV | Tertiary amine catalyst | 0.10 | 0.10 |
| Specflex ™,[1] NR 556 | Amine-$CO_2$ adduct foaming agent | 4.0 | 0.0 |
| | | 104.00 | 100.00 |
| | ISO side (I) | | |
| MDI Prepolymer | Modified MDI prepolymer with 23% NCO, with 2 NCO functionality | 100% | 100% |
| I/P (weight ratio) | — | 1.542 | 1.38 |
| Stoichiometry | — | 95% | 95% |

[1]Dow (Midland, MI);
[2]Evonik (Essen, Germany);
[3]Momentive (Waterford, NY)

Table 2, below compares various 508 mm (20") pad groove dimensions of two offset groove patterns (molded K7-3 and molded K7-10) with a control pattern circular K7 grooves, all spray-molded from a negative image on a polytetrafluoroethylene mold.

TABLE 2

Various Circumferential Groove Patterns

| Polishing Layer | Formulation | Density (g/cm$^3$) | Pattern | Groove width (mm) | Groove depth (mm) | Pitch: Distance between two adjacent grooves (mm) | Center offset (O, O') | Offset amount from two adjacent circumferential grooves |
|---|---|---|---|---|---|---|---|---|
| 1* | A | 0.52 | molded K7 | 0.504 | 0.762 | 1.78 | 0 | 0 |
| 2 | A | 0.52 | molded K7-3 | 0.504 | 0.762 | 1.70 to 1.85 | 10 mm (385 mils) | 76 μm (3 mil) |
| 3 | A | 0.52 | molded K7-10 | 0.504 | 0.762 | 1.52 to 2.03 | 33 mm (1286 mils) | 254 μm (10 mil) |
| 5* | B | 0.72 | molded K7 | 0.504 | 0.762 | 1.78 | 0 | 0 |
| 6 | B | 0.72 | molded K7-3 | 0.504 | 0.762 | 1.70 to 1.85 | 10 mm (385 mils) | 76 μm (3 mil) |
| 7 | B | 0.72 | molded K7-10 | 0.504 | 0.762 | 1.52 to 2.03 | 33 mm (1286 mils) | 254 μm (10 mil) |

*Denotes Comparative Example

TABLE 3

Comparative Control Pad (not spray molded)

| Example | Polishing Layer | Pattern | Sub Pad | Adhesive to sub-pad |
|---|---|---|---|---|
| 4* | IC1000 ™,[1] | K7 | Suba ™,[1] IV | PSA 3[1] |

*Denotes Comparative Example;
[1]Dow.

All pads were tested as follows:

Polishing: Details of the polishing conditions are indicated in Table 4, below. Polishing was carried out on a Mirra™ polisher (Applied Materials, Inc. Santa Clara, Calif.). Each new pad was broken in using a Saesol™ 8031C1 conditioning disk (Saesol Diamond Ind. Co., Ltd., Gyeonggi-do, Korea) with deionized (DI) water at 3.18 kg (7 lbs) down force (DF) for the indicated time, followed by polishing with 10 dummy wafers before three removal rate wafers were tested. The indicated polishing pad was broken in again for another 10 minutes with DI water at 3.18 kg (7 lbs) prior to a slurry change. In 100% in situ conditioning, the indicated polishing pad was subject to conditioning by the above mentioned conditioning disk all throughout polishing. In 50% in situ conditioning, the indicated polishing pad was subject to conditioning by the above mentioned conditioning disk for half of polishing time. For each polishing application, two polishing down forces (LDF and HDF) were tested. Sheet wafer substrates of 200 mm diameter were used in all polishing tests. For oxide and barrier polishing, the oxide wafers were made from tetraethoxysilicate (TEOS) deposition onto a polysilicon wafer; for copper polishing the substrate wafers were made by deposition of copper metal onto a bare silicon wafer. The polishing removal rate experiments were performed on 200 mm blanket S15KTEN TEOS sheet wafers (Novellus Systems, Inc., San Jose, Calif.). All polishing experiments were performed with a slurry flow rate of 200 ml/min; for oxide and barrier polishing, table rotation speed was 93 rpm and carrier rotation speed was 87 rpm. For copper polishing, table rotation speed was 77 rpm and carrier rotation speed was 71 rpm. A Saesol 8031C diamond pad conditioner was used to condition the polishing pads in situ, as indicated. Slurries used are reported in Table 4B, below. Slurries used were A, B and C, all of which are various colloidal silica based at solids contents and pHs tailored to the substrate in question. All polishing data reported in Table 5 are averages of three trials, each performed with the same pad on 3 separate substrates. In general, all averages are within ±1% of individual measured results.

The removal rate (RR) and removal uniformity (NU) were determined by measuring the film thickness before and after polishing using a KLA Tencor (Milpitas, Calif.) FX200™ metrology tool using a 49 point spiral scan with a 3 mm edge exclusion. Each of the removal rate experiments were performed three times. For copper sheet wafer polishing, RR was determined by measuring film thickness before and after polishing using a KLA Tencor RS200™ metrology tool. Each of RR and NU was calculated from the removal rate profile across a polished wafer with a 3 mm edge exclusion, and represents, respectively, the reduction in substrate thickness caused by polishing and the average variation of substrate thickness from a desired thickness goal. Polishing temperature was recorded by an IR probe measuring pad surface temperature during polishing. Defectivity from polishing was determined using a Surfscan™ SP2 unpatterned wafer surface inspection tool (KLA Tencor).

TABLE 4

| Polishing Conditions | | | | | | |
|---|---|---|---|---|---|---|
| Process | Substrate Wafer | Break-in time, minutes | Conditioning In-situ or ex-situ | Slurry | Polishing LDF, psi/kPa | Polishing HDF, psi/kPa |
| Oxide/ ILD | Oxide (TEOS) | 30 | 100% in-situ | A | 3/20.7 | 5/34.5 |
| Barrier | Oxide (TEOS) | 10 | 50% in-situ | B | 1.2/8.3 | 1.8/12.4 |
| Cu | Cu | 10 | 100% in-situ | C | 1.5/10.3 | 3/20.7 |

TABLE 4B

| Slurry Information | | | | |
|---|---|---|---|---|
| Slurry | Abrasive | Abrasive loading | Main additive | pH |
| A | Elongated colloidal silica particles | 16 wt. % | Quaternary ammonium | 10-11 |
| B | Colloidal silica particles | 12 wt. % | Benzotriazole, hydrogen peroxide | 10-11 |
| C[1] | Colloidal silica particles | <1 wt. % | Complexing agent, benzotriazole, hydrogen peroxide | ~7 |

[1]CSL9044C (FUJIFILM Planar Solutions, Tokyo Japan).

As shown in Table 5, above, the inventive polishing layer 2 enables improved removal rate at a lower polishing temperature than the Comparative polishing layers 1 and 4 which have a conventional circumferential groove pattern. Polishing layer 3 has an offset circumferential groove pattern which exceeds the preferred offset extent of the circumferential groove pattern in accordance with the present invention. Thus, each of Examples 3, 7, 11, 15, 19 and 23 shows an offset of from 25 to 200 μm between two adjacent circumferential grooves to give superior CMP polishing to results.

Table 6, below, gives defectivity performance of the offset polishing layers of the present invention.

TABLE 5

| Polishing Results With Colloidal Silica Slurries | | | | | | | | |
|---|---|---|---|---|---|---|---|---|
| Exam. | Substrate | Polishing Layer | Slurry | Down Force, kPa | Average RR (Å/min) | % RR Increase | Average % NU | Average Max Temp (° C.) |
| 1* | Oxide | 4* | A | 20.7 | 2460 | | 8.2 | 36.0 |
| 2* | Oxide | 1* | A | 20.7 | 2786 | 13% | 8.3 | 34.8 |
| 3 | Oxide | 2 | A | 20.7 | 2881 | 17% | 8.1 | 34.1 |
| 4* | Oxide | 3 | A | 20.7 | 2753 | 12% | 8.7 | 36.1 |
| 5* | Oxide | 4* | A | 34.5 | 4098 | | 5.7 | 46.1 |
| 6* | Oxide | 1* | A | 34.5 | 4633 | 13% | 5.8 | 45.5 |
| 7 | Oxide | 2 | A | 34.5 | 4708 | 15% | 6.0 | 45.0 |
| 8 | Oxide | 3 | A | 34.5 | 4530 | 11% | 5.2 | 47.4 |
| 9* | Oxide | 4* | B | 8.3 | 630 | | 11.2 | 23.4 |
| 10* | Oxide | 1* | B | 8.3 | 748 | 19% | 12.0 | 23.0 |
| 11 | Oxide | 2 | B | 8.3 | 786 | 25% | 12.3 | 22.2 |
| 12 | Oxide | 3 | B | 8.3 | 741 | 18% | 12.9 | 23.5 |
| 13* | Oxide | 4* | B | 12.4 | 921 | | 11.3 | 25.9 |
| 14* | Oxide | 1* | B | 12.4 | 1108 | 20% | 12.5 | 25.2 |
| 15 | Oxide | 2 | B | 12.4 | 1145 | 24% | 11.6 | 26.0 |
| 16 | Oxide | 3 | B | 12.4 | 1084 | 18% | 11.2 | 26.8 |
| 17* | Copper | 4* | C | 10.4 | 3459 | | 5.6 | 30.8 |
| 18* | Copper | 1* | C | 10.4 | 3816 | 10% | 5.3 | 31.4 |
| 19 | Copper | 2 | C | 10.4 | 3813 | 10% | 4.8 | 30.3 |
| 20 | Copper | 3 | C | 10.4 | 3626 | 5% | 3.6 | 32.3 |
| 21* | Copper | 4* | C | 20.7 | 6239 | | 7.1 | 41.9 |
| 22* | Copper | 1* | C | 20.7 | 7016 | 12% | 5.5 | 42.1 |
| 23 | Copper | 2 | C | 20.7 | 7090 | 14% | 5.3 | 41.6 |
| 24 | Copper | 3* | C | 20.7 | 6914 | 11% | 6.6 | 43.5 |

*Denotes Comparative Example.

TABLE 6

| Defectivity | | | | | | | | | |
|---|---|---|---|---|---|---|---|---|---|
| Exam | Substrate | Polishing Layer | Slurry | Down Force, kPa | RR (Å/min) | % NU | Max Temp (° C.) | Post CMP Defect Count | Average Defect count |
| 25* | Oxide | 1* | A | 20.7 | 2750 | 8.7 | 34.8 | 919 | |
| 26* | Oxide | 1* | A | 20.7 | 2805 | 7.2 | 34.7 | 829 | |
| 27* | Oxide | 1* | A | 20.7 | 2803 | 8.9 | 34.8 | 866 | 871 |
| 28 | Oxide | 2 | A | 20.7 | 2845 | 7.8 | 33.8 | 609 | |
| 29 | Oxide | 2 | A | 20.7 | 2889 | 9.6 | 34.6 | 492 | |
| 30 | Oxide | 2 | A | 20.7 | 2909 | 7.0 | 33.8 | 828 | 643 |
| 31 | Oxide | 3 | A | 20.7 | 2730 | 9.6 | 36.2 | 1044 | |
| 32 | Oxide | 3 | A | 20.7 | 2769 | 7.5 | 36.1 | 1170 | |
| 33 | Oxide | 3 | A | 20.7 | 2760 | 8.9 | 36.1 | 1325 | 1180 |
| 34* | Oxide | 1* | A | 34.5 | 4645 | 5.2 | 45.5 | 377 | |
| 35* | Oxide | 1* | A | 34.5 | 4629 | 6.6 | 45.4 | 338 | |
| 36* | Oxide | 1* | A | 34.5 | 4624 | 5.5 | 45.6 | 393 | 369 |
| 37 | Oxide | 2 | A | 34.5 | 4650 | 7.4 | 45.2 | 156 | |
| 38 | Oxide | 2 | A | 34.5 | 4718 | 5.2 | 45.0 | 313 | |
| 39 | Oxide | 2 | A | 34.5 | 4758 | 5.4 | 44.9 | 295 | 255 |
| 40 | Oxide | 3 | A | 34.5 | 4446 | 5.5 | 47.4 | 312 | |
| 41 | Oxide | 3 | A | 34.5 | 4529 | 5.7 | 47.1 | 362 | |
| 42 | Oxide | 3 | A | 34.5 | 4615 | 4.4 | 47.7 | 358 | 344 |

*Denotes Comparative Example

The polishing layer 2 of the present invention delivered a dramatically lower post CMP defect count than the polishing layer 1 in polishing with an elongated colloidal silica slurry. The less preferred polishing layer 3 of the present invention delivered improved defectivity at a higher polishing down-force.

Additional polishing data with slightly denser polishing layers is presented in Tables 7 and 8, below.

TABLE 7

| TEOS Oxide Removal Rate With Elongated Colloidal Silica Slurry Formulation | | | | | | | |
|---|---|---|---|---|---|---|---|
| Example | Polishing Layer | Slurry | Polishing Down Force (kPa) | Average RR (Å/min) | % RR Increase over polishing layer 4 | Average Max Temp (° C.) | Normalized RR to polishing layer 4 |
| 43* | 4* | A | 20.7 | 2460 | — | 36.0 | 100% |
| 44* | 5* | A | 20.7 | 2850 | 16% | 34.2 | 116% |
| 45 | 6 | A | 20.7 | 3049 | 24% | 32.3 | 124% |
| 46 | 7 | A | 20.7 | 2944 | 20% | 33.1 | 120% |
| 47* | 4* | A | 34.5 | 4098 | — | 46.1 | 100% |
| 48* | 5* | A | 34.5 | 4681 | 14% | 43.8 | 114% |
| 49 | 6 | A | 34.5 | 4946 | 21% | 42.5 | 121% |
| 50 | 7 | A | 34.5 | 4801 | 17% | 42.3 | 117% |

*Denotes Comparative Example.

The polishing layers of the present invention delivered higher removal rate than the IC1000™ control pad (C.Ex 43 and 47), the polishing layer with no offset circumferential grooves (C.Ex 44 and 48), and the polishing layer with offset circumferential grooves that exceeded the preferred offset of the present invention (Ex. 46 and 50). The less preferred polishing layers in Examples 46 and 50 delivered improved RR. However, all polishing layers of the present invention in Examples 45-46 and 49-50 enable polishing at a lower temperature.

TABLE 8

| Copper Removal Rate With Colloidal Silica Slurry Formulation | | | | | | | |
|---|---|---|---|---|---|---|---|
| Example | Polishing Layer | Slurry | Polishing Down Force (kPa) | Average RR (Å/min) | % RR Increase over polishing layer 4 | Average Max Temp (° C.) | Normalized RR to polishing layer 4 |
| 51* | 4* | C | 10.3 | 3459 | Control 1 | 30.8 | 100% |
| 52* | 5* | C | 10.3 | 3556 | 3% | 30.5 | 103% |
| 53 | 6 | C | 10.3 | 3826 | 11% | 30.1 | 111% |

TABLE 8-continued

Copper Removal Rate With Colloidal Silica Slurry Formulation

| Example | Polishing Layer | Slurry | Polishing Down Force (kPa) | Average RR (Å/min) | % RR Increase over polishing layer 4 | Average Max Temp (° C.) | Normalized RR to polishing layer 4 |
|---|---|---|---|---|---|---|---|
| 54 | 7 | C | 10.3 | 3724 | 8% | 29.3 | 108% |
| 55* | 4* | C | 20.7 | 6239 | Control 1 | 41.9 | 100% |
| 56* | 5* | C | 20.7 | 6556 | 5% | 41.4 | 105% |
| 57 | 6 | C | 20.7 | 6856 | 10% | 41.0 | 110% |
| 58 | 7 | C | 20.7 | 6608 | 6% | 39.9 | 106% |

*Denotes Comparative Example.

The polishing layers of the present invention delivered higher removal rate than the IC1000™ control pad (C.Ex 51 and 55), and the polishing layer with no offset circumferential grooves (C.Ex 52 and 56). The polishing layer with offset circumferential grooves exceeding the preferred offset limit of the present invention (Ex. 54 and 58) also provided improved removal rates. The polishing layers of the present invention also enable polishing at a lower temperature.

Example 59

Offset Circumferential Grooves All Having a Common Geometric Center

Slurry A was used to polish three TEOS Oxide substrate using a soft commercially available polyurethane CMP polishing pad, the IK2020H pad (Dow) and average removal rates (RR) and Defect count were determined. The (i) control pad had a control K7 groove pattern, an offset (ii) pad a polishing layer with a 38 mm (1.5") offset circumferential groove pattern having a common center; and a larger offset pad (iii) had a polishing layer with a 102 mm (4") offset circumferential groove pattern having a common center. Polishing was conducted at both 20.7 (LDF) and 34.5 kPa (HDF) downforce in the above mentioned polishing conditions. Removal rates were 3% better than control (i) at LDF and 5% worse than control (i) at HDF for the polishing layer (ii) and were 11% better at LDF and 0% improved at HDF for the polishing layer (iii). Defect count was dramatically (equal to or greater than 50%) worse for polishing layers (ii) and (iii) than for the control (i).

Example 60

Tearing of Partial or Incomplete Circumferential Grooves

A test was conducted on a Buehler Ecomet™ 4 polisher with an Automet™ 2 power head (Buehler, a division of Illinois Tool Works, Lake Bluff, Ill.). An IC1000™ polishing pad (polishing pad 4) with concentric circular grooves in a pattern of a 3.05 mm (120 mil) pitch, 0.5 mm (20 mil) width, and 0.75 mm (30 mil) depth, was offset punched by 4 mm to 229 mm (9") in diameter to create partial grooves at the pad polishing layer edge. The offset-punched polishing layer was placed to the polishing platen of the polisher using a double-sided pressure sensitive adhesive film. A commercial 100 mm (4") diameter conditioning disk, LPX-AR3B66 LPX-W (Saesol Diamond Ind. Co., Ltd., Gyeonggi-do, Korea) was used to condition the polishing layer. The test conditions were: 3.6 kg (8 lb) conditioning disk down force; disk speed of 60 rpm; platen speed of 180 rpm; and DI water flow rate of 280 mL/min. The polishing layer edge was examined under a scanning electron microscope after conditioning for 4 hours with the DI water and the edge was frayed, including torn edges and loose debris on the edge of the polishing layer.

We claim:

1. A chemical mechanical polishing pad for planarizing at least one of semiconductor, optical and magnetic substrates comprises a polishing layer that has a geometric center, the polishing layer containing a plurality of offset circumferential grooves that have a plurality of geometric centers, each circumferential groove being set apart a pitch distance from its nearest or adjacent circumferential groove or grooves and most circumferential grooves having a geometric center that is different than its adjacent circumferential groove and wherein when going from an innermost circumferential groove to an outermost circumferential groove, relative location of the geometric center of each successive circumferential groove moves toward the geometric center of the polishing layer.

2. The CMP polishing pad as claimed in claim 1, wherein the polishing layer contains an outermost circumferential groove that is complete and continuous and that is concentric with the polishing layer itself or has a common geometric center with and is not offset from the geometric center of the polishing layer.

3. The CMP polishing pad as claimed in claim 1, wherein except for an innermost and an outermost circumferential groove, each of the plurality of offset circumferential grooves has two adjacent circumferential grooves.

4. The CMP polishing pad as claimed in claim 3, wherein a majority of the offset circumferential grooves that have two adjacent circumferential grooves are offset from their respective two adjacent circumferential grooves by from 25 to 200 μm (1 to 8 mils).

5. The CMP polishing pad as claimed in claim 1, wherein a majority of the offset circumferential grooves are offset by from 200 to 35,000 μm from the geometric center of the polishing layer.

6. The CMP polishing pad as claimed in claim 1, wherein a majority of the offset circumferential grooves are offset by from 500 to 21,500 μm from the geometric center of the polishing layer.

7. The CMP polishing pad as claimed in claim 6, wherein all of the offset circumferential grooves except an outermost circumferential groove are offset by from 500 to 21,500 μm from the geometric center of the polishing layer.

8. The CMP polishing pad as claimed in claim 1, wherein each of the circumferential grooves in polishing pad is polygonal, having from 3 to 36 sides, or is substantially circular.

9. The CMP polishing pad as claimed in claim 1, wherein the polishing layer comprises a plurality of radial grooves.

* * * * *